US009829273B2

(12) United States Patent
Cazes

(10) Patent No.: US 9,829,273 B2
(45) Date of Patent: Nov. 28, 2017

(54) GUN GRIP WITH FINGER PLACEMENT AND HOLSTERING FEATURES

(71) Applicant: Jason Lane Cazes, Bellevue, WA (US)

(72) Inventor: Jason Lane Cazes, Bellevue, WA (US)

( * ) Notice: Subject to any disclaimer, the term of this patent is extended or adjusted under 35 U.S.C. 154(b) by 0 days.

(21) Appl. No.: 15/183,794

(22) Filed: Jun. 16, 2016

(65) Prior Publication Data

US 2017/0059272 A1 Mar. 2, 2017

Related U.S. Application Data

(60) Provisional application No. 62/180,572, filed on Jun. 16, 2015.

(51) Int. Cl.

| | |
|---|---|
| ***F41C 23/00*** | (2006.01) |
| ***F41C 23/10*** | (2006.01) |
| ***F41C 33/00*** | (2006.01) |
| ***F41C 33/02*** | (2006.01) |
| ***F41C 33/04*** | (2006.01) |

(52) U.S. Cl.
CPC ..... *F41C 23/10* (2013.01); *F41C 33/008* (2013.01); *F41C 33/0236* (2013.01); *F41C 33/041* (2013.01)

(58) Field of Classification Search
CPC .... F41C 23/10; F41C 33/008; F41C 33/0236; F41C 33/041
USPC ..... 42/71.04–74
See application file for complete search history.

(56) References Cited

U.S. PATENT DOCUMENTS

| | | | | |
|---|---|---|---|---|
| 2,320,450 | A * | 6/1943 | Valenzuela | F41C 33/008 224/271 |
| 3,156,059 | A * | 11/1964 | Crain | F41C 33/008 42/71.02 |
| D259,432 | S * | 6/1981 | Pharr, Jr. | D22/108 |
| 4,689,908 | A * | 9/1987 | McClellan | F41C 23/10 224/198 |
| 6,726,072 | B2 * | 4/2004 | Rugh | A45F 5/02 224/269 |
| 8,752,322 | B2 * | 6/2014 | Kresser | F41C 3/00 42/71.01 |
| 2005/0188587 | A1 * | 9/2005 | Danas | F41C 23/10 42/72 |

* cited by examiner

*Primary Examiner* — Samir Abdosh
(74) *Attorney, Agent, or Firm* — The Olmsted Law Group, PLLC; Andrew Olmsted

(57) ABSTRACT

A device designed to replace or supplement the factory grip of a firearm, said device improving accuracy by allowing better placement of the user's trigger finger upon the trigger of the firearm, said device also providing an attachment point for carry of the firearm about the user's person when the firearm is not in use.

4 Claims, 29 Drawing Sheets

GUN GRIP WITH FINGER PLACEMENT AND HOLSTERING FEATURES

CROSS-REFERENCE TO RELATED APPLICATIONS

This application claims priority of Provisional Patent Application 62/180,572, filing date Jun. 16, 2015.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention is in the technical field of firearms. More particularly, the present invention is in the technical field of handgun grips. Most particularly, the present invention is in the technical field of handgun grips with finger placement features and holstering features.

For centuries, humans have used firearms for hunting, sport and self-defense. For the purposes of this application, firearms may be broken down into three broad types: shotguns, rifles and handguns. Shotguns and rifles, in general, feature elongated designs, whereas handguns are typically constructed in such a manner as to allow the user to easily hold and fire the firearm with one hand.

It is desirable for firearms users to fire their weapons accurately and safely. For handgun users, the ability to effectively conceal a handgun, while still allowing quick access, is also a common desire. These factors have given rise to a multitude of products designed for the shooting community, many of which serve intended purposes of improving accuracy and allowing concealed carry when a user does not wish to display the fact he is carrying a handgun.

For ease in understanding the present invention, a brief overview of proper shooting technique is warranted. It is generally accepted in the shooting community that a handgun shooter fires a handgun most accurately when the fleshy portion of a shooter's index finger (the portion equidistant between the terminus of the finger and the first knuckle) is placed on the trigger. Often times, the configuration of standard handgun grips and the length of the shooter's index finger, taken in tandem, cause the shooter to improperly place his index finger on the trigger of a handgun. As a result of this placement, the shooter often tends to "pull" or "push" the handgun slightly to one side when firing, reducing accuracy. Proper finger placement on the trigger allows the user to smoothly pull the trigger backwards, leading to more accurate shot placement.

A brief discussion of standard handgun holsters is also warranted. Holsters may be worn in a variety of places on the user's body and may either conceal a handgun or allow for open carry. Almost all holsters on the market are designed to envelop the handgun within a "sheath-like" material. When the user wishes to remove the handgun from a holster, he slides the handgun out from the sheath, reversing this process when he wishes to holster his handgun.

The primary problem with holsters on the market is holsters contribute a fair amount of bulk to the outline of a handgun, which is often undesirable. In addition, many holsters require attachment mechanisms to affix the holster to the user's clothing, some requiring partial undress to remove a holster from the user's person. A product that allows discrete carry of a handgun, while improving accuracy is thus highly desirable. It is the goal of the present invention to remedy problems found with current products in the prior art.

The inventor has performed a prior art search. Prior art teaches clips that allow a handgun owner to clip his handgun onto his clothing. Prior art also teaches accuracy-improving devices designed to place a user's index finger in the optimal position on a trigger. The inventor believes the present invention is a new and useful invention not disclosed by the prior art and believes patent protection is warranted.

SUMMARY OF THE INVENTION

A grip assembly for handguns comprises a palm rest that is attached to a handgun by replacing the factory palm rest(s), by utilizing factory attachment points or by a wrap-around design. The top of the palm rest features a finger rest that runs forward parallel to, and below, the slide or barrel of the handgun, said finger rest ending slightly further from the end of the barrel as the trigger of the handgun. Said finger rest features a gap between the internal surface of the finger rest and the frame of the handgun, providing proper placement of the user's finger on the trigger when in use and forming a clip for the user to attach the handgun about his person when the handgun is not in use. The entire grip assembly may be manufactured from materials commonly used in the industry including, but not limited to, natural and synthetic rubbers, wood, nylon, composite plastics and metals. Furthermore, impregnation of the grip assembly's material with abrading particles or texturing of the surface of the grip assembly may provide additional tack.

The specific aspects, features and advantages of the present invention will become apparent from the following detailed description of the varying embodiments of the present invention.

DETAILED DESCRIPTION OF THE INVENTION

The spirit and scope of the present invention allow for construction from a variety of materials and methods. It is anticipated wood, molded plastics, nylons, rubbers, and composites would allow the most cost-effective and light-weight construction, though the inventor does not intend to limit the construction of the present invention to one specific type of material or one specific type of construction.

All Figs. show right-handed versions of the present invention. The inventor does not intend to limit the present invention to only right-handed embodiments. Those skilled in the art will realize the present application also discloses left-handed embodiments by placement of the finger rest portion of the present invention on the left side of the handgun frame.

Furthermore, those skilled in the art will realize that due to the variety of handgun shapes and sizes, it is not feasible to submit figures and detailed descriptions of embodiments for every handgun design on the market. The figures and detailed descriptions of various embodiments are intended not to limit the scope of the application, but to provide as wide a range of disclosure of the present invention as is reasonable.

Figure 1:
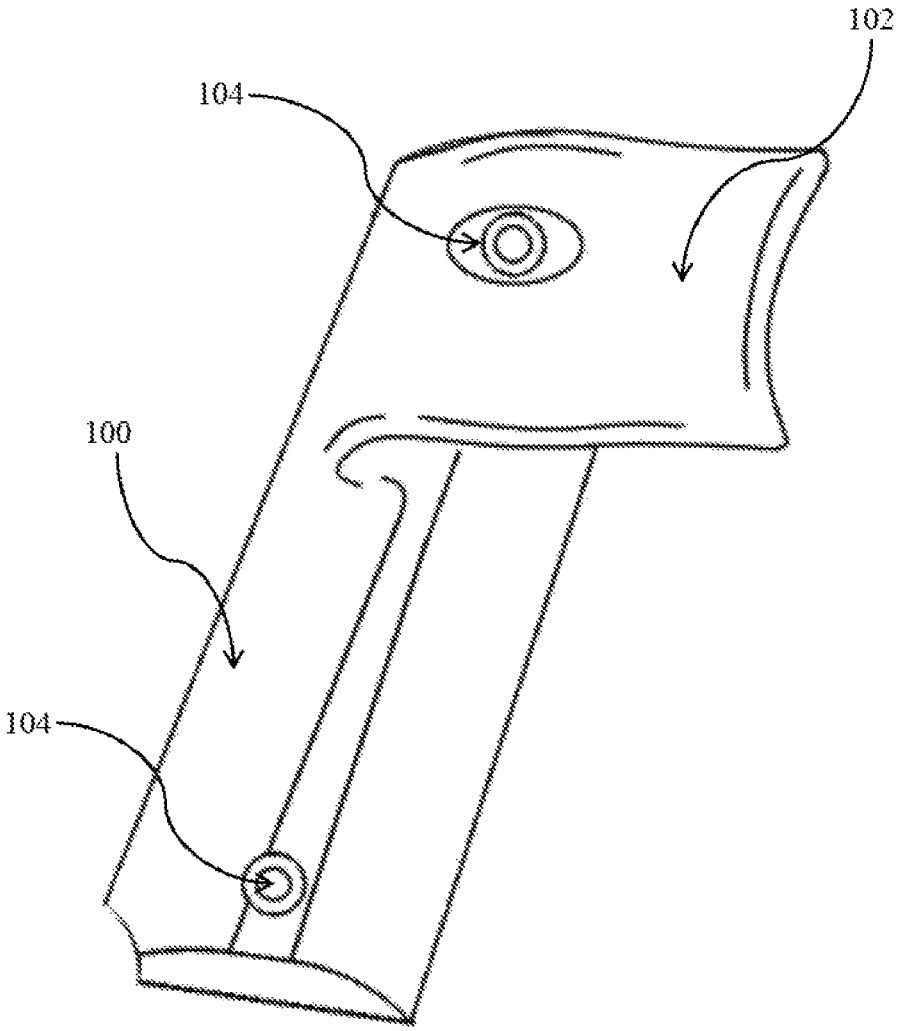
FIG. 1 is a side view of one embodiment of the present invention.

Referring now to the view of the present invention as shown in FIG. 1, there is shown the present invention designed for one popular model of handgun. A palm rest 100 is featured running vertically and at a slight forward angle for the user to grasp. At the top of the palm rest 100, a finger rest 102 continues forward toward the end of the barrel of the handgun. FIG. 1 also demonstrates attachment points 104 for the user to affix the present invention to the frame of a handgun.

Figure 2:
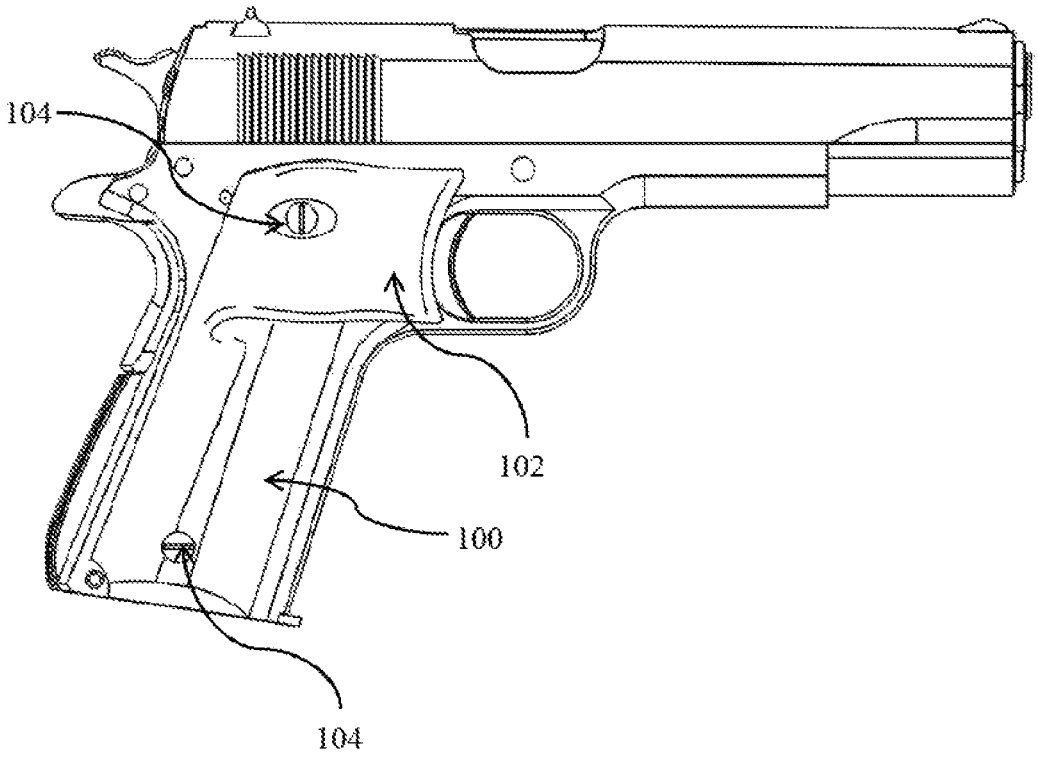
FIG. 2 is a side view of the same embodiment, shown affixed to one popular handgun design.

FIG. 2 is a side view of the present invention attached to one popular model of handgun. The furthest-forward portion of the finger rest 102 is shown ending slightly before the trigger on this model of handgun.

Figure 3:
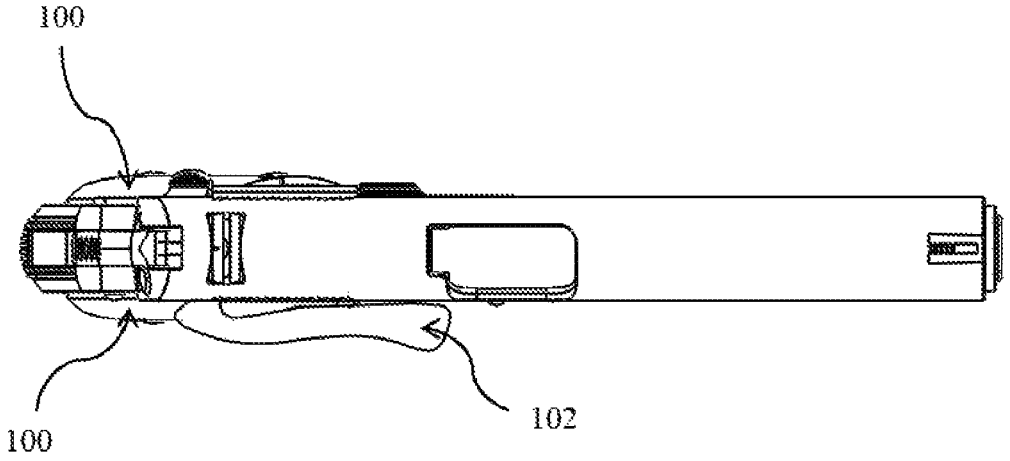
FIG. 3 is a top view of the same embodiment, showing protrusion from the handgun's frame and demonstrating the finger rest and clip features of the present invention.

FIG. 3 shows the present invention as attached to the same model of handgun as FIGS. 1-2. The inner surface of the finger rest 102 protrudes slightly from the frame of the handgun. The finger rest 102 helps position the user's finger so that the proper region of the user's finger is placed on the trigger when he is ready to fire. In addition, FIG. 3 demonstrates the clip function of the present invention. There is a slight gap between the internal portion of the finger rest 102 and the frame of the handgun. The slight gap allows for an additional clip feature served by utilizing the finger rest 102 as a clip when the user wishes to clip the handgun about his person when not in use.

Figure 4:
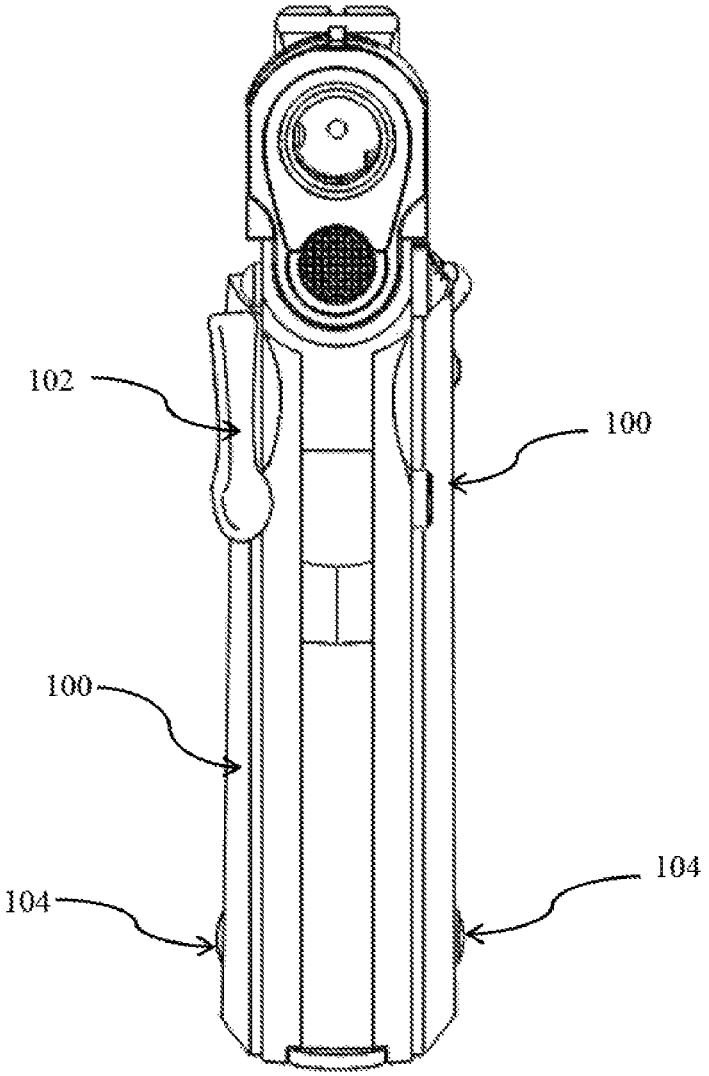
FIG. 4 is a front view of the same embodiment.
Figure 5:
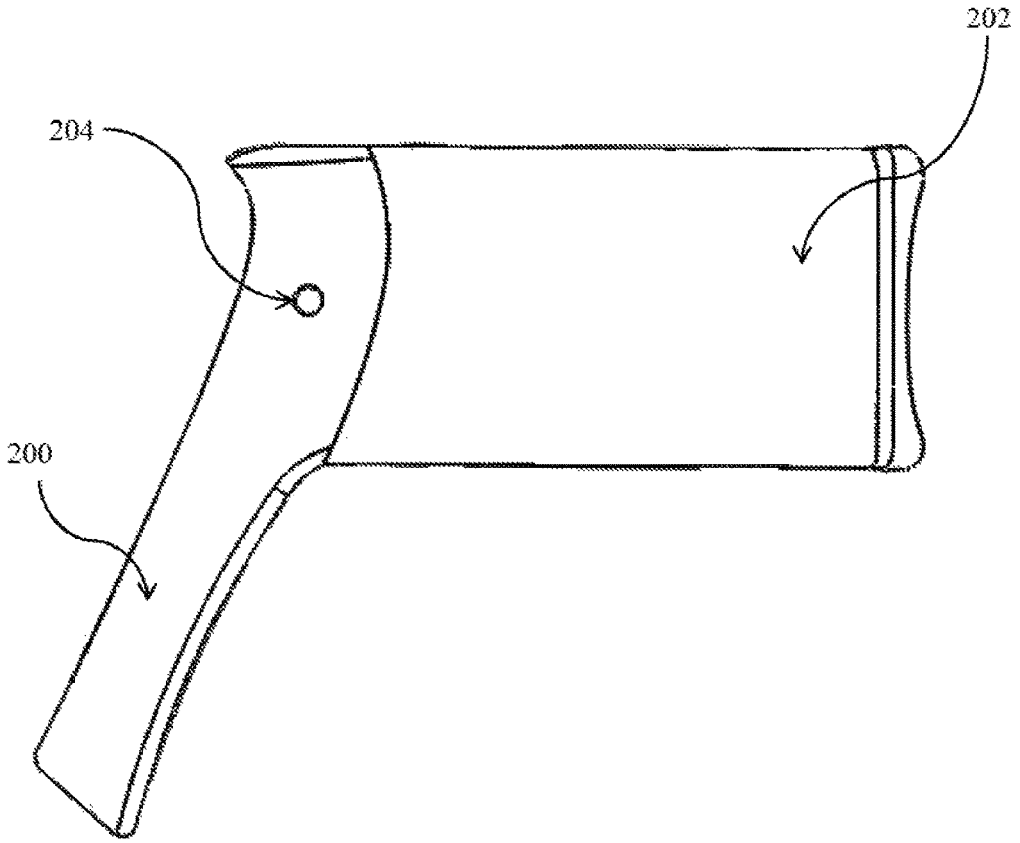
FIG. 5 is a side view of an alternative embodiment of the present invention.
Figure 6:
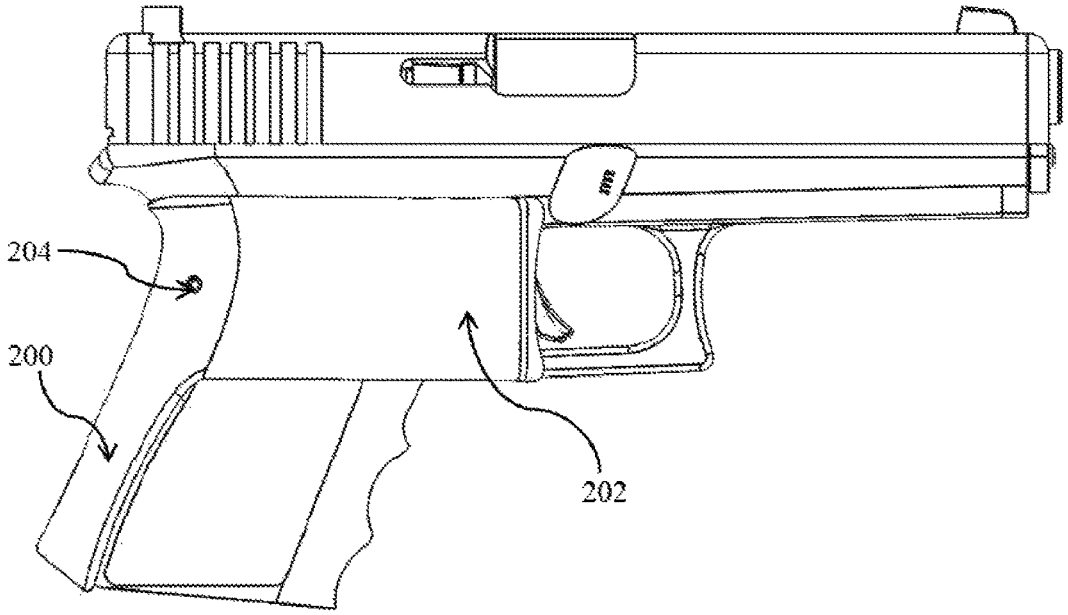
FIG. 6 is a side view of the same embodiment of FIG. 5, shown affixed to an alternative popular handgun design.

FIG. 4 is a front view of the present invention, looking down the barrel of the gun. FIG. 4 best-demonstrates the relative location of the finger rest 102 to the palm rest 100.

Referring now to FIGS. 5-6, 8 and 10 there is shown an alternative embodiment of the present invention, designed for attachment to another popular model of handgun. As with FIGS. 1-4, there is shown a palm rest 200, finger rest 202 and attachment points 204, all of which serve the same function as the prior embodiment of the present invention.

Figure 7:
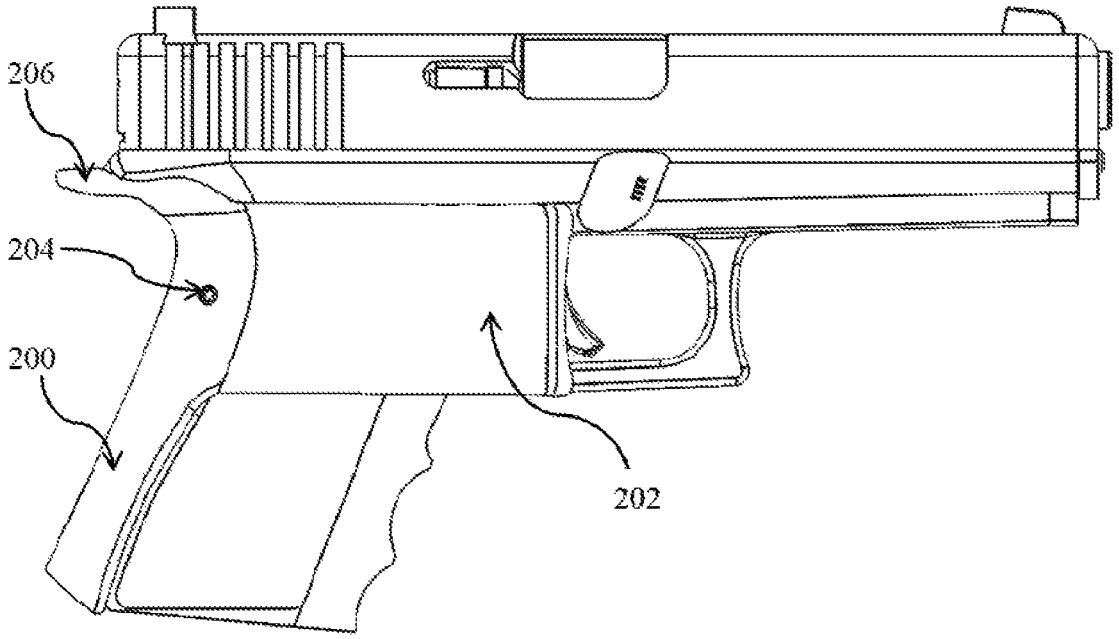
FIG. 7 is a side view of a substantially-similar embodiment as FIG. 5, this embodiment including a beavertail feature.
Figure 8:
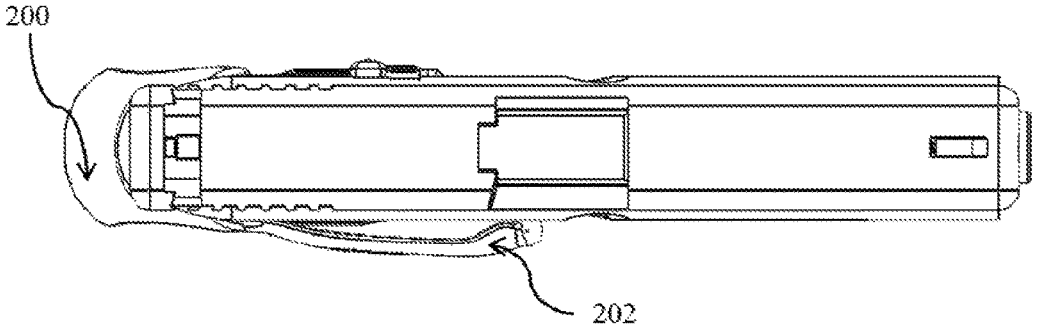
FIG. 8 is a top view of the same embodiment as shown in FIG. 5, showing protrusion from the handgun's frame and demonstrating the finger rest and clip features of the present invention.

FIG. 7 demonstrates one slight variation to this particular embodiment of the present invention. Some handgun models have the tendency to knick the user's thumb knuckle when the slide recoils backwards as the gun is fired. This variation of the present invention features a beavertail 206 to protect the user's knuckle.

Figure 9:
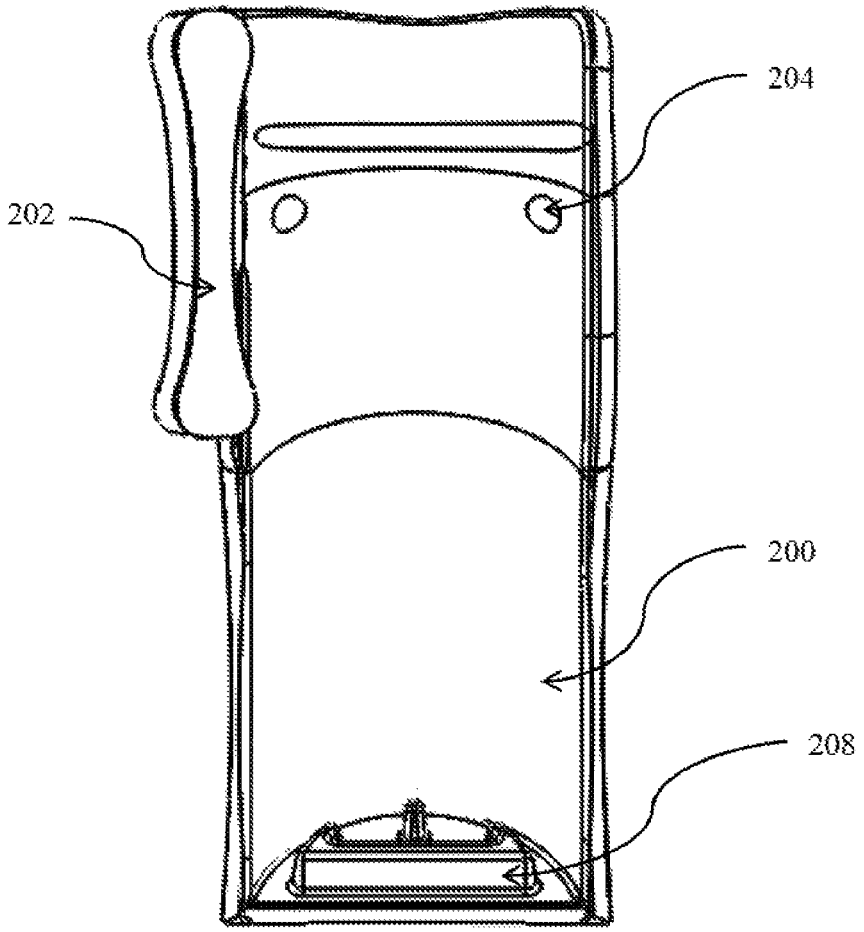
FIG. 9 is an internal view of the same embodiment as shown in FIG. 5, showing placement of attachment holes and the placement of an attachment tab.
Figure 10:
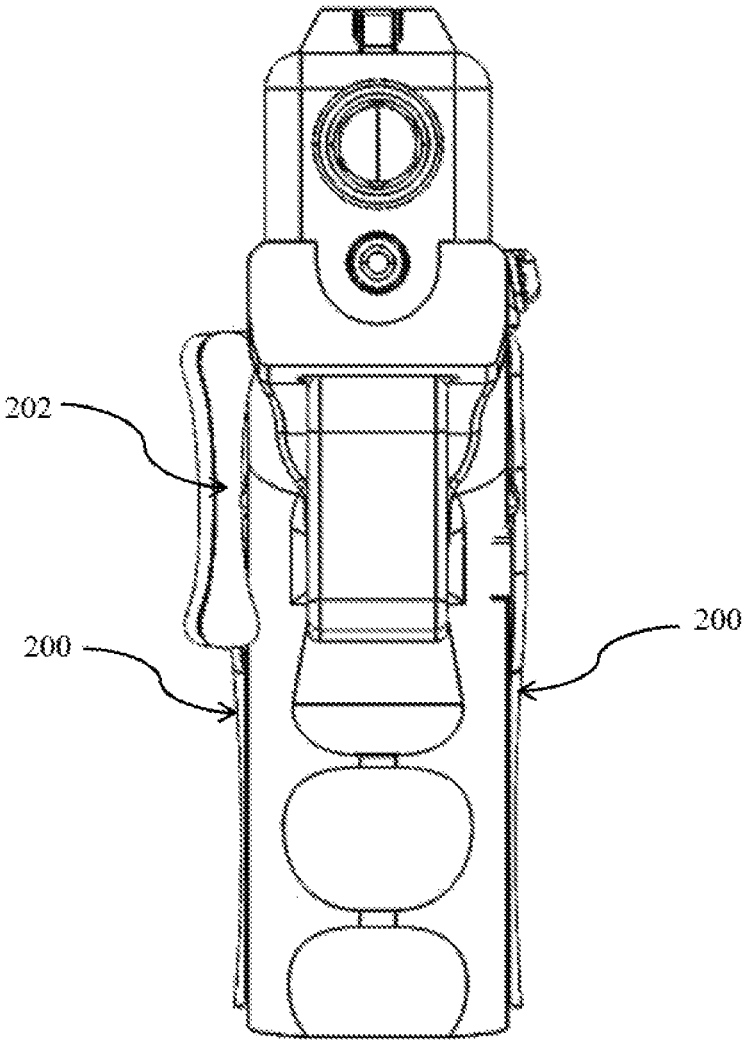
FIG. 10 is a front view of the same embodiment of the present invention as shown in FIG. 5, shown attached to a handgun frame.

FIG. 9 is a front-to-rear view of the internal components of this embodiment of the present invention. FIG. 9 shows the locations of the attachment points 204, inner portion of the palm rest 200 and the finger rest 202. The model of handgun for which this embodiment was designed features a hollow opening at the base of the grip. This embodiment of the present invention may feature an attachment tab 208, designed to slide into the hollow opening, providing an additional attachment point.

Figure 11:
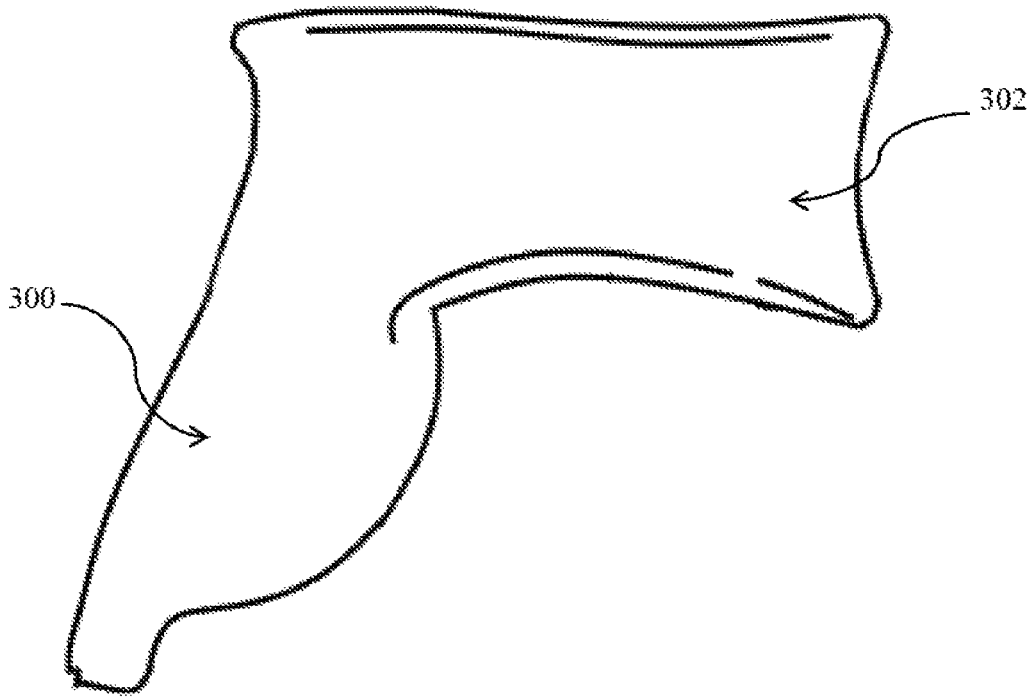
FIG. 11 is a side view of another alternative embodiment of the present invention.

Referring to FIG. 11, there is shown another alternative embodiment to the present invention. Shown in FIG. 11 are the relative locations of the palm rest 300 and finger rest 302.

Noticeably absent are attachment points as featured in prior Figs. It is common for handguns to not feature holes for grip attachment, instead using attachment tabs internal to the grip components to secure the grips to the handgun frame. The alternative embodiment of the present invention as shown in FIGS. 11-18 demonstrate such attachment mechanisms.

Figure 12:
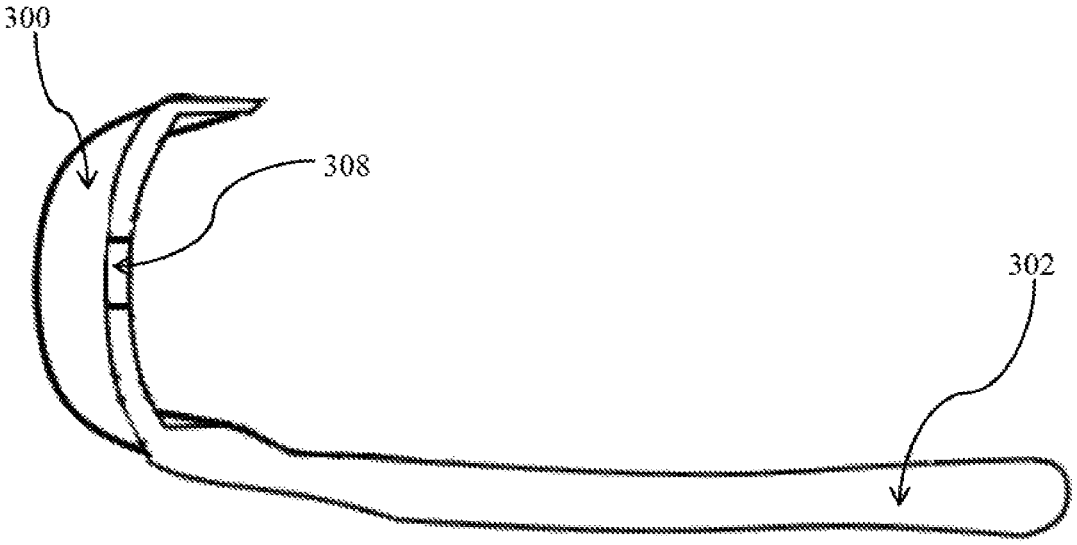
FIG. 12 is a top view of the same embodiment of the present invention shown in FIG. 11, showing protrusion from the handgun's frame and demonstrating the finger rest and clip features of the present invention.

FIG. 12 shows a top view of the alternative embodiment of the present invention, apart from a handgun. An attachment tab 308 is shown. The precise location of the attachment tab 308 on this embodiment is variable, but will correspond to the location of attachment points within the frame of handguns for which this embodiment is designed.

Figure 13:
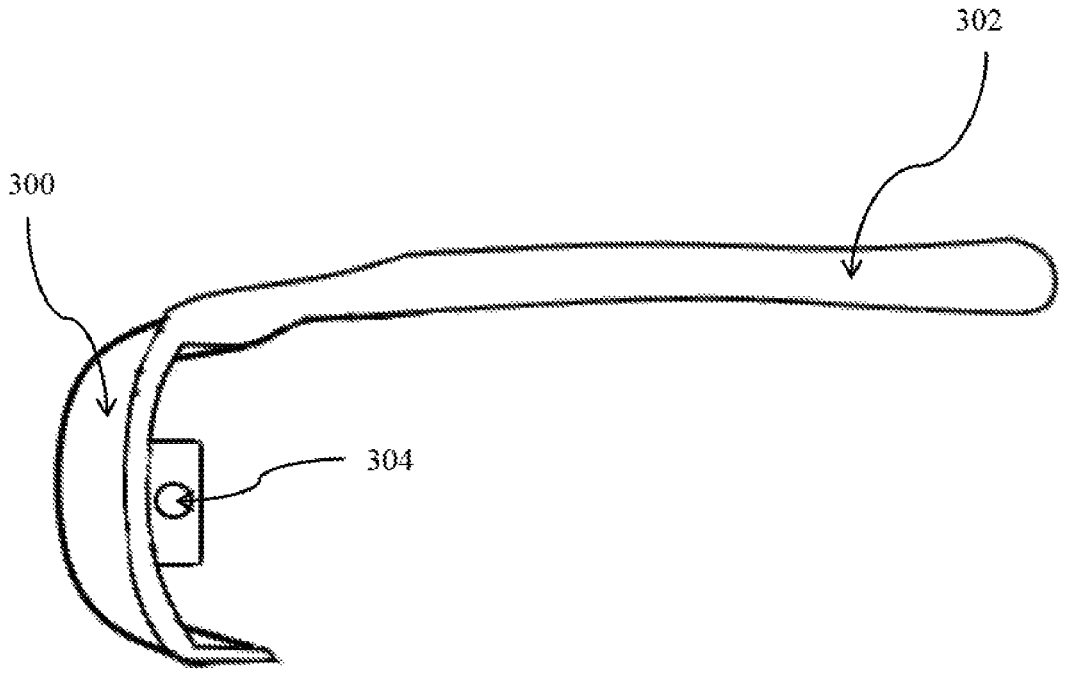
FIG. 13 is a bottom view of the same embodiment of the present invention shown in FIG. 11.

FIG. 13 is a bottom view of the same embodiment of the present invention. The model of handgun for which this embodiment is intended features a hole at the base of the grip. This embodiment features an attachment point 304 for the user to place the pin from the factory grip.

Figure 14:
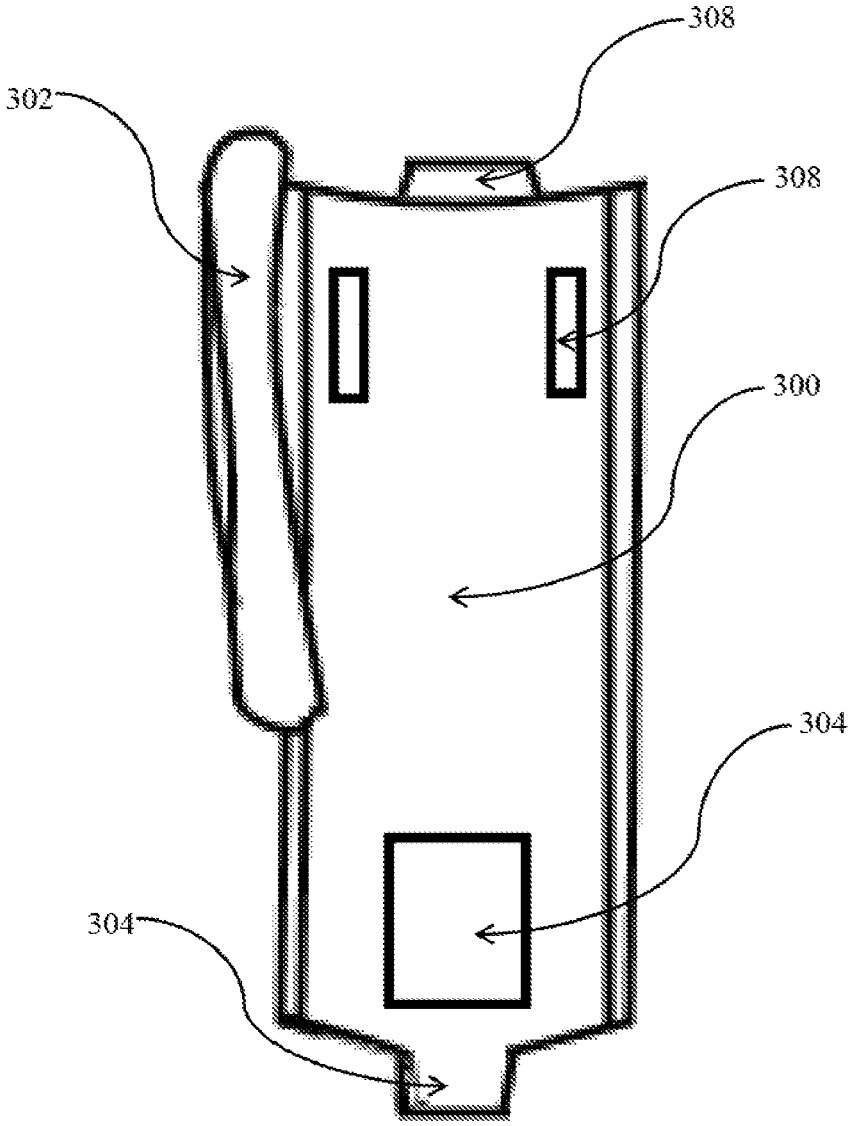
FIG. 14 is an internal view of the same embodiment of the present invention shown in FIG. 11, showing placement of attachment holes and attachment tabs.

FIG. 14 is a front-to-rear view of internal components of the current embodiment of the present invention showing its particular attachment features. There are shown attachment tabs 308 at the top and sides of the palm rest 300. Furthermore, there are shown attachment points 304 at the bottom of the palm grip 300 for placement of the factory grip pin.

Figure 15:
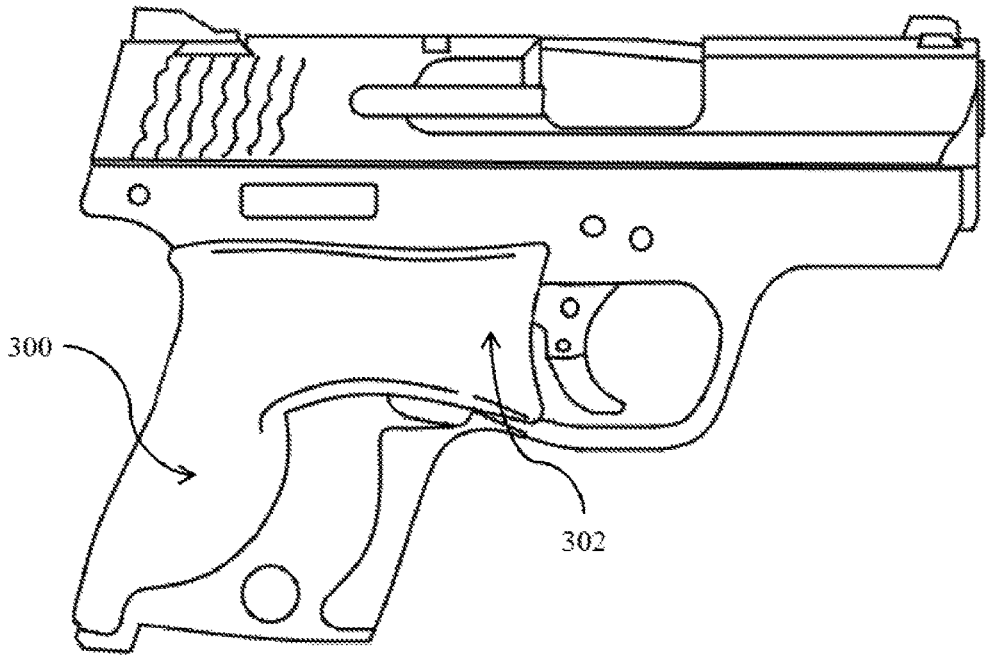
FIG. 15 is a side view of a the embodiment shown in FIG. 11, installed on another handgun design.

FIG. 15 shows placement of the current embodiment upon the frame of the handgun for which it was designed.

Figure 16:
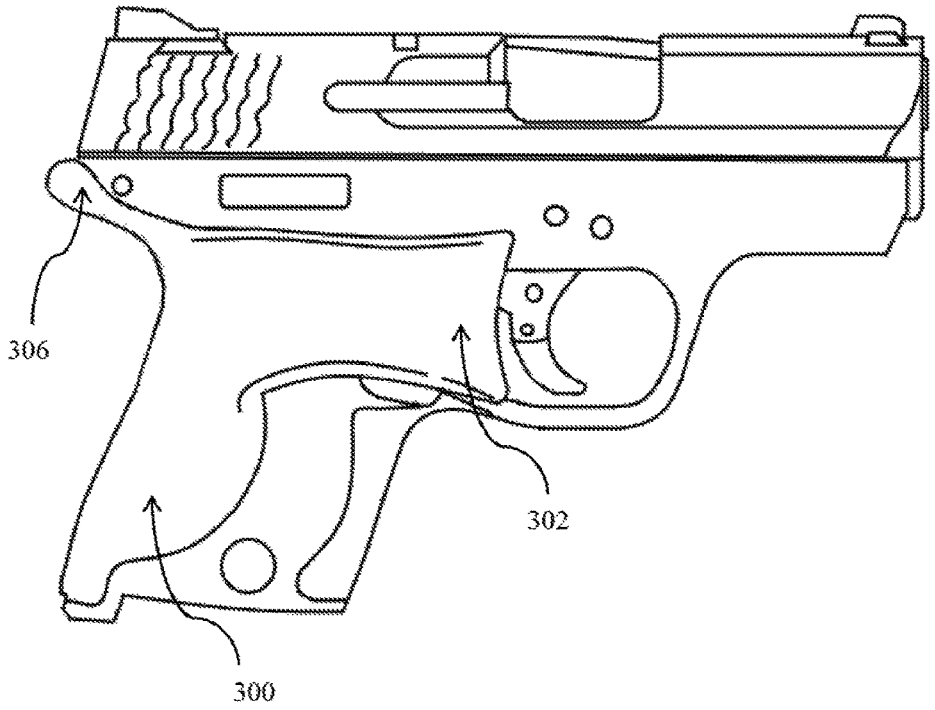
FIG. 16 is a side view of a substantially-similar embodiment as FIG. 15, this embodiment including a beavertail feature.

FIG. 16 shows a slight variation to the current embodiment that features a beavertail 306 with substantially similar form and function as the one in FIG. 7.

Figure 17:
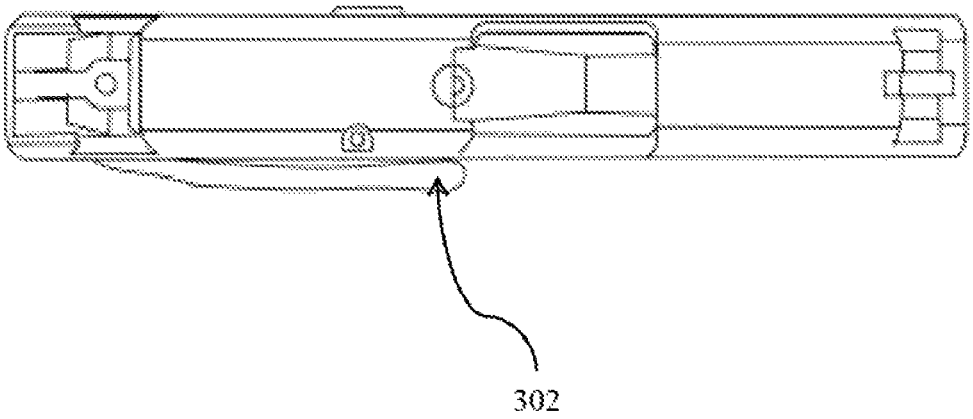
FIG. 17 is a top view of the same embodiment as shown in FIG. 11, showing protrusion from the handgun's frame and demonstrating the finger rest and clip features of the present invention.
Figure 18:
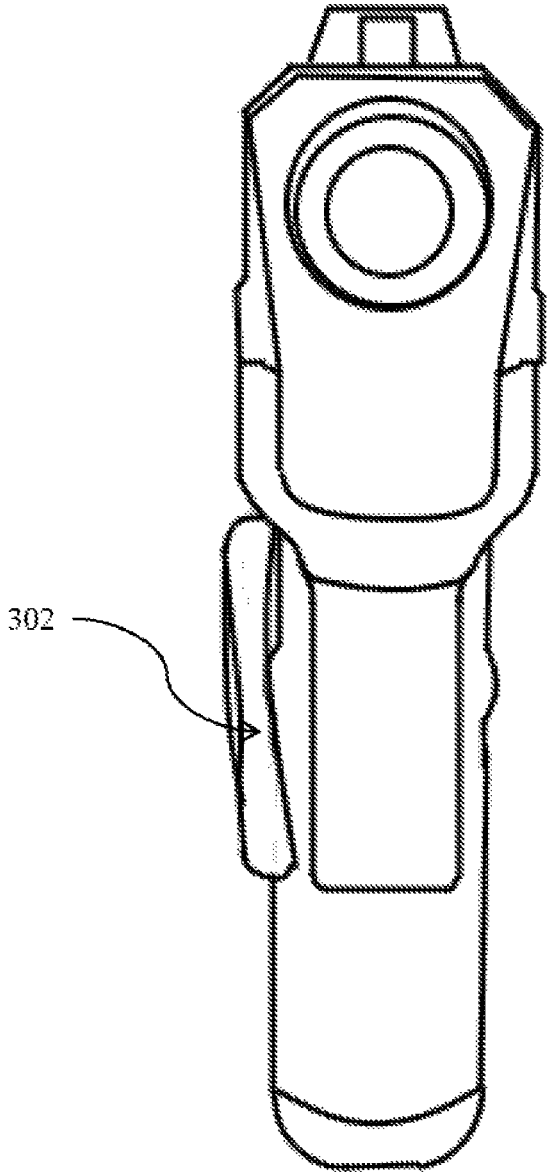
FIG. 18 is a front view of the same embodiment as shown in FIG. 11, showing protrusion from the handgun's frame and demonstrating the finger rest and clip features of the present invention.

FIGS. 17-18 show top and front views of the current embodiment of the present invention upon the frame of a handgun, demonstrating the relative location of the present invention to the handgun's body.

Figure 19:
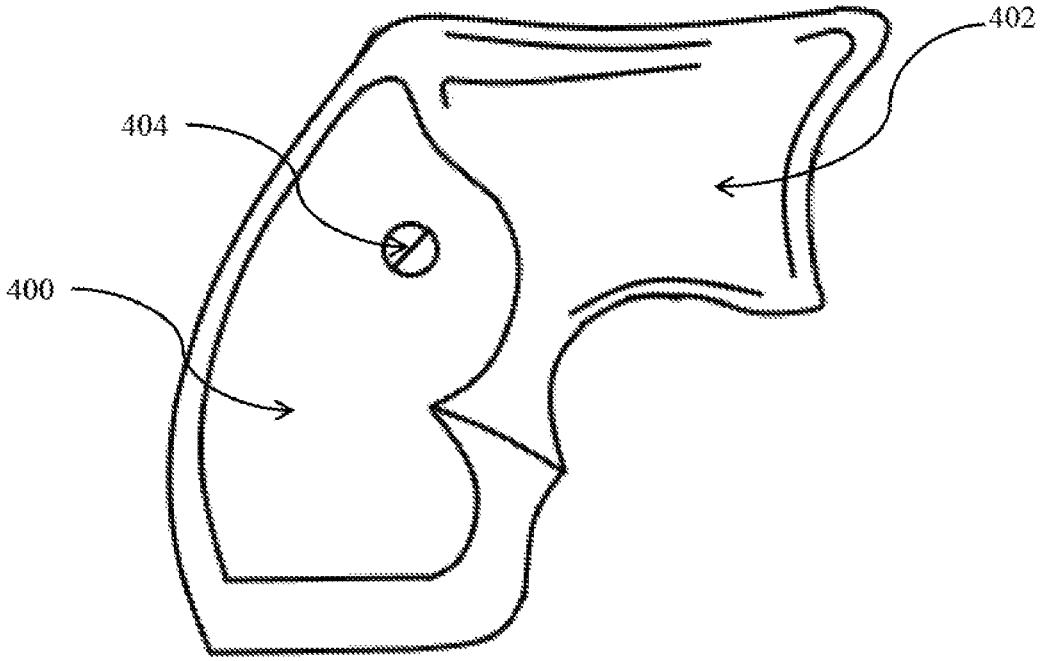
FIG. 19 is a side view of another alternative embodiment of the present invention.

FIG. 19 is a view of another alternative embodiment of the present invention, as designed for handguns commonly referred to as revolvers. There are shown the palm rest 400, finger rest 402 and an attachment point 404, all of which serve the same function as in the previously discussed embodiments of the present invention.

Figure 20:
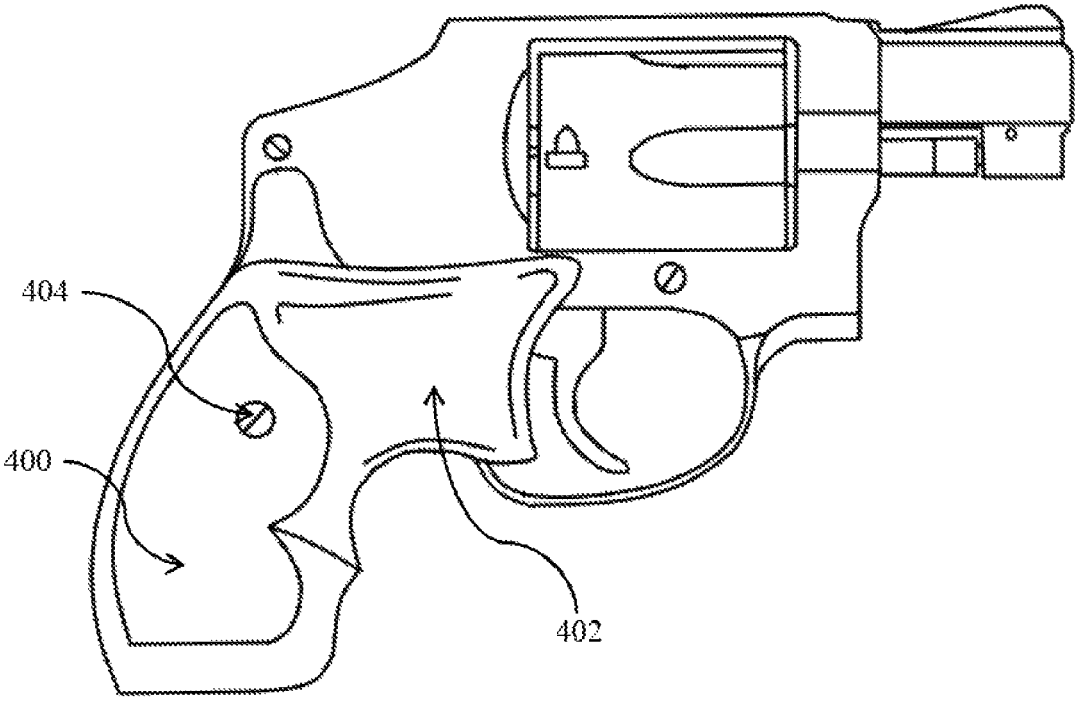
FIG. 20 is a side view of the same embodiment of FIG. 19, shown affixed to an alternative handgun design.
Figure 21:
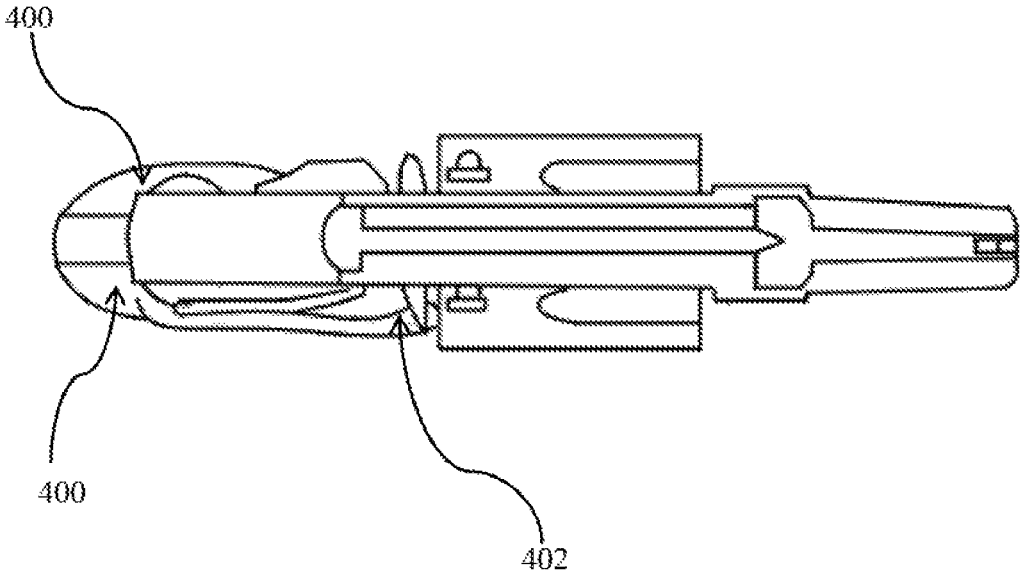
FIG. 21 is a top view of the same embodiment of the present invention shown in FIG. 19, showing protrusion from the handgun's frame and demonstrating the finger rest and clip features of the present invention
Figure 22:
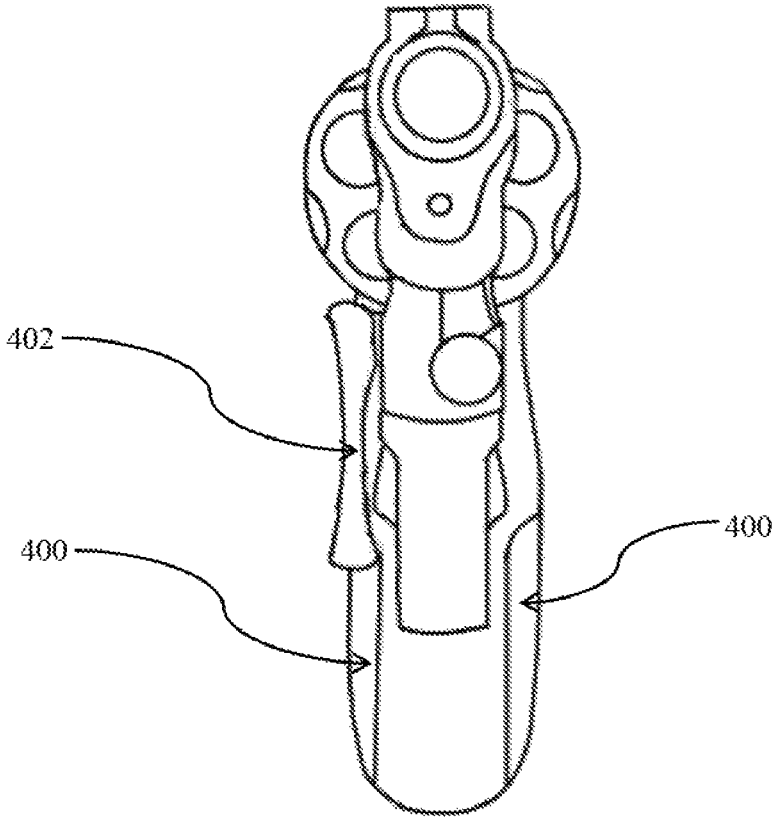
FIG. 22 is a front view of the same embodiment of the present invention shown in FIG. 19, affixed to a handgun frame.

FIGS. 20-22 shows placement of the current embodiment on a revolver and demonstrate the relative positioning of the components to the handgun overall.

Figure 23:
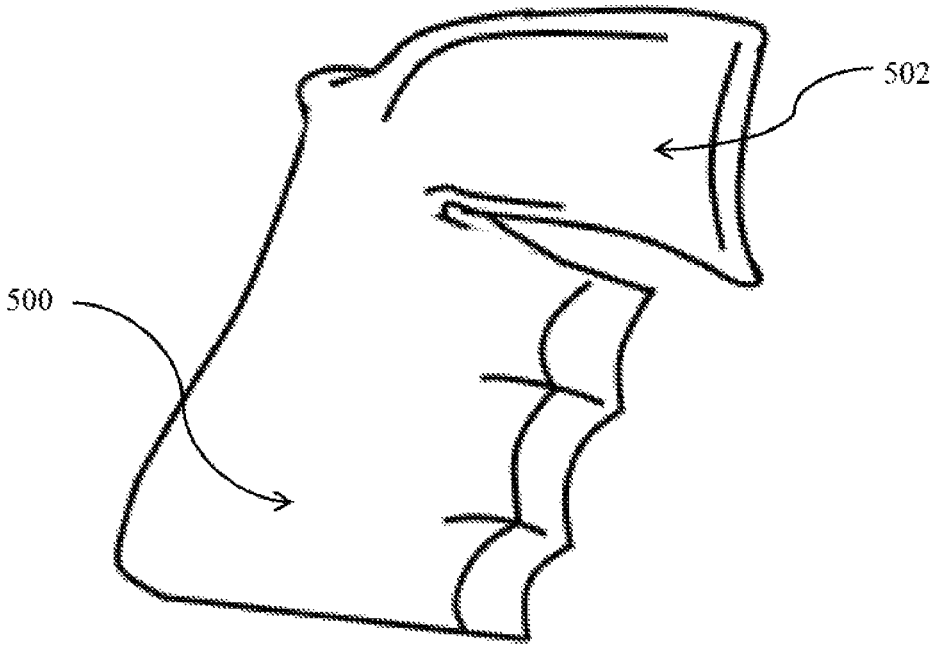
FIG. 23 is a side view of another alternative embodiment of the present invention.
Figure 24:
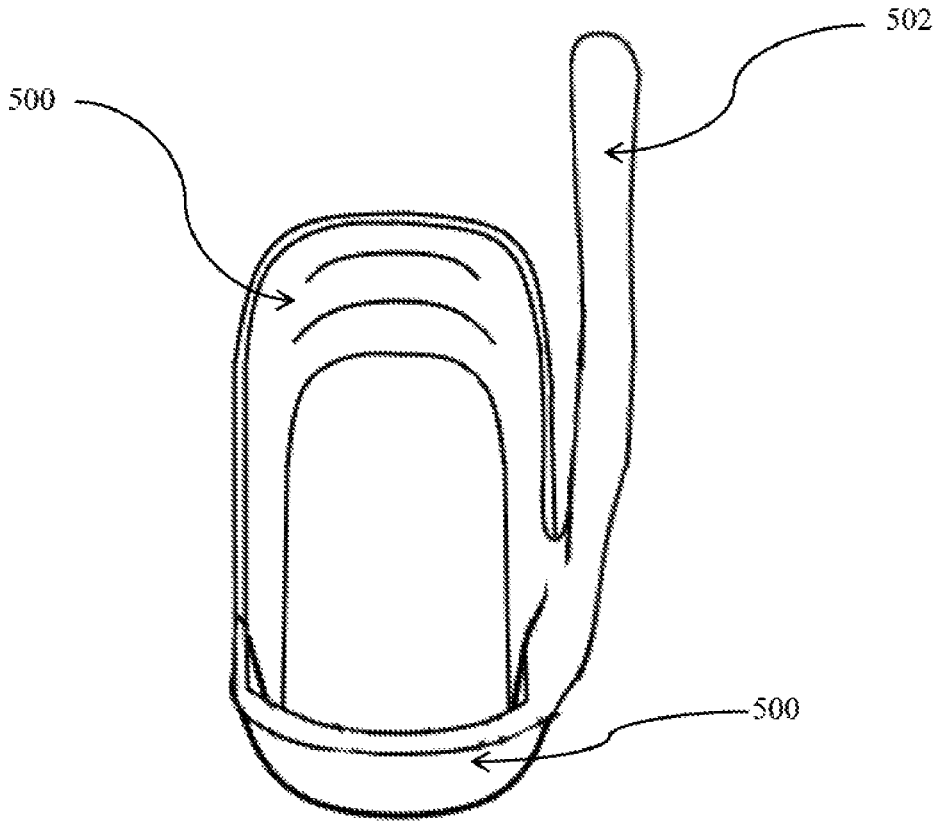
FIG. 24 is a top view of the same embodiment of the present invention shown in FIG. 23.

FIGS. 23-24 are views of an alternative embodiment of the present invention, this embodiment designed to slide onto the grip of handguns with a wraparound design. In this embodiment, the palm rest 500 wraps about the factory grip of the handgun. The palm rest 500 is constructed of materials of sufficient stretch to fit around the grip of the handgun and hold this embodiment in place via compression of the materials of the palm rest 500 around the grip of the handgun. As with all other embodiments of the present invention, the current embodiment features a finger rest 502, which serves the same function in this embodiment as in the others.

Figure 25:
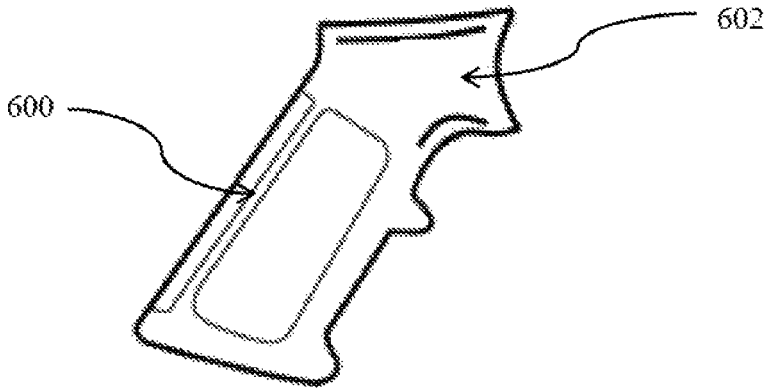
FIG. 25 is a side view of another alternative embodiment of the present invention.
Figure 26:
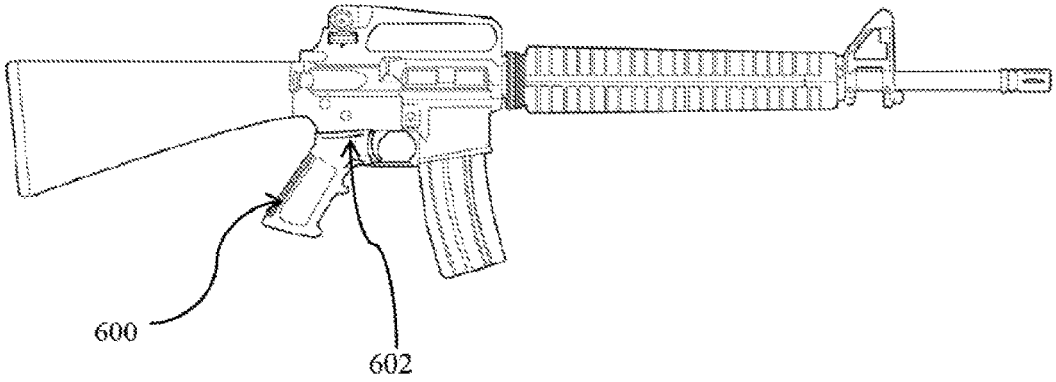
FIG. 26 is side view of the same embodiment of FIG. 25, shown affixed to the pistol grip portion of one popular type of rifle and demonstrating applicability of the present invention to long guns.

FIGS. 25-26 are views of an alternative embodiment of the present invention, demonstrating how it may also be used on all guns featuring pistol-style grips. As with the other embodiments, there is shown a palm rest 600 and a finger rest 602. This embodiment may be slid over the grip of a long gun, such as with the embodiment of the invention shown in FIGS. 23-24, or may completely replace the factory grip.

Figure 27:
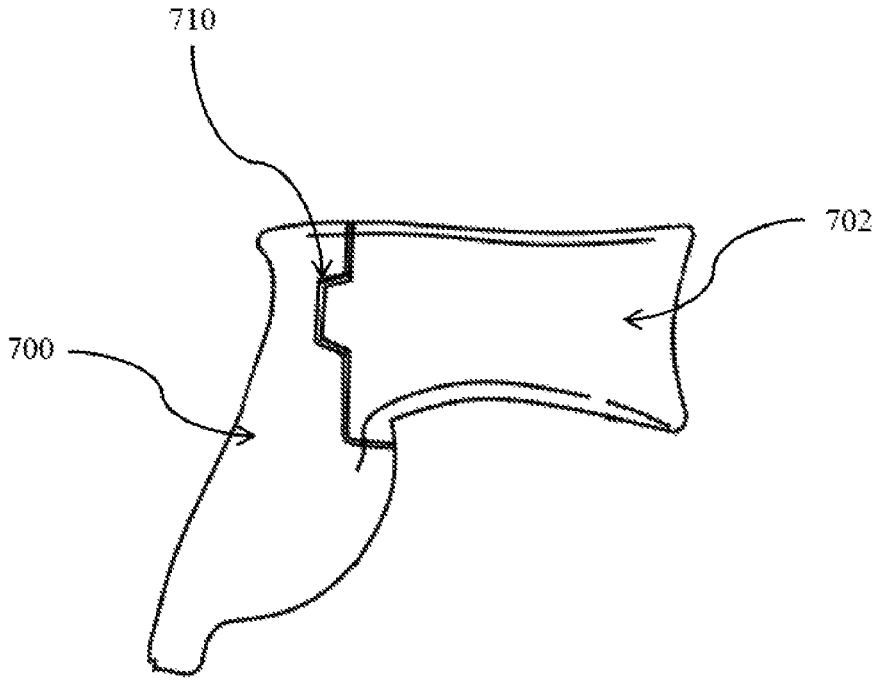
FIG. 27 is a side view of another alternative embodiment of the present invention.
Figure 28:
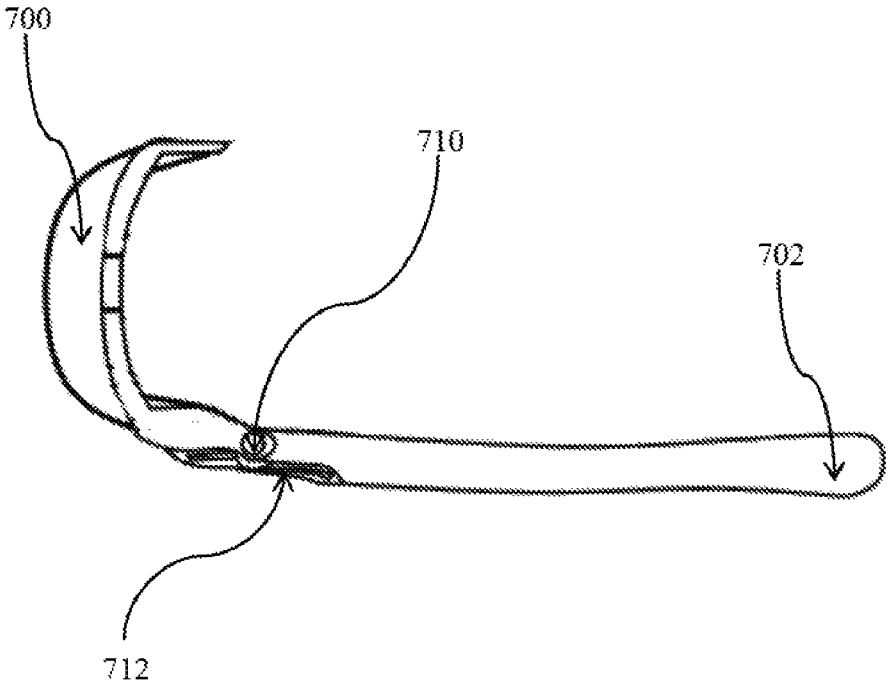
FIG. 28 is a top view of the same embodiment of the present invention shown in FIG. 27.
Figure 29:
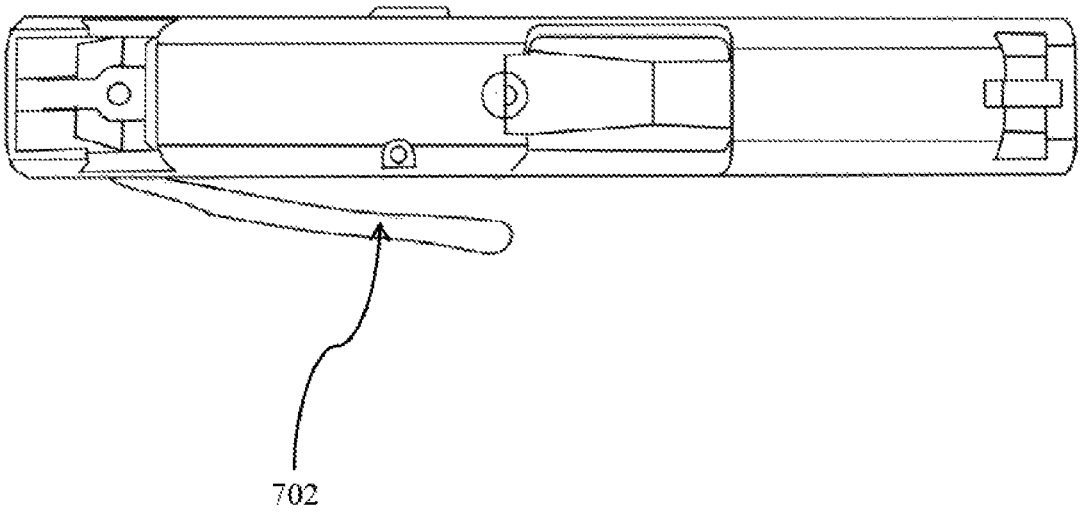
FIG. 29 is a top view of the same embodiment of the present invention shown in FIG. 28 and attached to one popular model of handgun.

FIGS. 27-29 demonstrate a final embodiment of the present invention. This particular embodiment features a hinge 710 as well as a spring 712. To avoid redundancies, the hinge 710 and spring 712 are only shown placed on the embodiment of the present invention shown in FIGS. 11-18. The inventor would like to explicitly point out all embodiments of the present invention may possibly feature a hinge 710 and spring 712.

FIG. 27 shows a hinge 710 and its placement relative to the palm rest 700 and finger rest 702 portion of this embodiment of the present invention. The hinge 710 allows the finger rest 702 to swing outward when pulled away from the frame of a gun.

FIG. 28 shows the location of a spring 712 internal to the hinge 710 discussed in the preceding paragraph. When the finger rest 702 is pulled outward from the frame of the gun, tension is placed upon the spring 712. This tension may provide for a more secure attachment of the gun to the user's person or clothing when the holstering feature of the present invention is used. The spring 712 may be a coil spring, a leaf spring, or a spring of any other type as suitable to the spirit and function of the present invention.

FIG. 29 shows how the interaction between the hinge 710 and spring 712 would allow the finger rest 702 to be adjusted further from the frame of the gun, when the holstering feature is desired.

In order to best use all embodiments of the present invention, the user affixes the palm rest 100 200 300 400 600 700 about the frame of the handgun or grip, either by replacing the factory grip using factory-attachment points (where available) or by sliding the palm rest 500 about the frame (in the wraparound embodiment). Once the palm rest 100 200 300 400 500 600 700 is affixed to the frame of the handgun or gun, the design of all embodiments leads to proper placement of the finger rest 102 202 302 402 502 602 702 along the frame of the handgun or gun.

Firing a handgun featuring the present invention is functionally identical to firing one without the present invention. All safety features remain accessible. Overall safety is improved by accuracy improvements through better placement of the user's index finger upon the trigger. A handgun fired more accurately is a safer handgun.

Use of the holstering feature of the present invention is equally simple. By nature of its design, the gap between the internal surface of the finger rest 102 202 302 402 502 602 702 and the slide or barrel of the handgun allows the finger rest 102 202 302 402 502 602 702 to serve the additional function of a clip. This clipping feature allows the user to discretely clip the handgun about his body when not in use. The preferred use of the clip feature is to allow the user to clip the handgun to his clothing or belt, though the inventor does not intend to limit the application to only clip to clothing. Embodiments of the present invention utilizing a hinge 710 and a spring 712 operate in the same manner, with the additional security of a spring-tensioned attachment mechanism.

In broad embodiment, the present invention is a firearm grip with finger placement and holstering features.

While the foregoing written description of the invention enables one of ordinary skill to make and use what is considered presently to be the best mode thereof, those of ordinary skill will understand and appreciate the existence of variations, combinations, and equivalents of the specific embodiments, methods, and examples herein. The invention should therefore not be limited by the above described embodiments, methods, and examples, but by all embodiments and methods within the scope and spirit of the invention as claimed.

What is claimed is:

1. A grip for the handle of a handheld firearm, said firearm comprising at least a handle, frame and trigger, said grip comprising at least one sidewall with an interior portion, an exterior portion, a top portion, a bottom portion, a fore portion, and an aft portion;

a means for removably attaching the grip to the frame of a firearm;

a finger rest for the user's trigger finger located at the top of the grip, extending forward from the fore portion of the grip to a terminal distance just aft of the trigger of the firearm, said finger rest extending parallel and adjacent to the trigger, said finger rest having a thickness greater than the lower portion of the grip so that the portion of the user's finger halfway between the fingertip and first knuckle is allowed to rest on the trigger when the firearm is held by the user;

a gap between the interior portion of the finger rest and the frame of the firearm, said gap of sufficient width to allow the interior portion of the finger rest to be used as a clip for attachment of the firearm about the user's clothing.

2. A grip for the handle of a handheld firearm, said firearm comprising at least a handle, frame and trigger, said grip comprised of an elastic sidewall material that allows the grip to stretch sufficiently to slide over the factory grip;

an interior portion, an exterior portion, a top portion, a bottom portion, a fore portion, and an aft portion;

a finger rest for the user's trigger finger located at the top of the grip, extending forward from the fore portion of the grip to a terminal distance just aft of the trigger of the firearm, said finger rest extending parallel and adjacent to the trigger, said finger rest having a thickness greater than the lower portion of the grip so that the portion of the user's finger halfway between the fingertip and first knuckle is allowed to rest on the trigger when the firearm is held by the user;

a gap between the interior portion of the finger rest and the frame of the firearm, said gap of sufficient width to allow the interior portion of the finger rest to be used as a clip for attachment of the firearm about the user's clothing.

3. A grip for the handle of a handheld firearm, said firearm comprising at least a handle, frame and trigger, said grip comprised of at least one sidewall with an interior portion, an exterior portion, a top portion, a bottom portion, a fore portion, and an aft portion;

a means for removably attaching the grip to the frame of a firearm;

a finger rest for the user's trigger finger located at the top of the grip, extending forward from the fore portion of the grip to a terminal distance just aft of the trigger of the firearm, said finger rest extending parallel and adjacent to the trigger, said finger rest having a thickness greater than the lower portion of the grip so that the portion of the user's finger halfway between the fingertip and first knuckle is allowed to rest on the trigger when the firearm is held by the user.

4. A grip for the handle of a handheld firearm, said firearm comprising at least a handle, frame and trigger, said grip comprised of at least one sidewall with an interior portion, an exterior portion, a top portion, a bottom portion, a fore portion, and an aft portion;

a means for removably attaching the grip to the frame of a firearm;

a finger rest for the user's trigger finger located at the top of the grip, extending forward from the fore portion of the grip to a terminal distance just aft of the trigger of the firearm, said finger rest extending parallel and adjacent to the trigger, said finger rest having a thickness greater than the lower portion of the grip so that the portion of the user's finger halfway between the fingertip and first knuckle is allowed to rest on the trigger when the firearm is held by the user;

said finger rest further adjustably attached via a pin pivot point and spring combination to the remainder of the grip, allowing the finger rest to open away from the frame under spring tension and set if desired, or allowed to return back to a closed state.

* * * * *